US005080076A

United States Patent [19]

Eckert

[11] Patent Number: 5,080,076

[45] Date of Patent: Jan. 14, 1992

[54] FUEL INJECTION SYSTEM FOR INTERNAL COMBUSTION ENGINES

[75] Inventor: Konrad Eckert, Stuttgart, Fed. Rep. of Germany

[73] Assignee: Robert Bosch GmbH, Stuttgart, Fed. Rep. of Germany

[21] Appl. No.: 195,932

[22] Filed: May 19, 1988

[30] Foreign Application Priority Data

Jul. 6, 1987 [DE] Fed. Rep. of Germany ..... 3722263

[51] Int. Cl.[5] ..... F02M 37/04

[52] U.S. Cl. ..... 123/506; 123/494; 73/119 A

[58] Field of Search ..... 123/506, 494, 458, 500, 123/501; 73/119 A

[56] References Cited

U.S. PATENT DOCUMENTS

| | | | |
|---|---|---|---|
| 3,319,613 | 5/1967 | Begley | 123/494 |
| 3,575,145 | 4/1971 | Steiger | 123/494 |
| 3,884,195 | 5/1975 | Murtin | 123/494 |
| 4,530,337 | 7/1985 | Laufer | 123/506 |
| 4,535,742 | 8/1985 | Laufer | 123/506 |
| 4,655,184 | 4/1987 | Eckert | 123/494 |
| 4,718,391 | 1/1988 | Rembold | 123/494 |

FOREIGN PATENT DOCUMENTS

| | | | |
|---|---|---|---|
| 0153932 | 9/1984 | Japan | 123/494 |
| 2061403 | 5/1981 | United Kingdom | 123/506 |
| 2165895 | 4/1986 | United Kingdom | 123/506 |

*Primary Examiner*—Carl Stuart Miller

*Attorney, Agent, or Firm*—Edwin E. Greigg; Ronald E. Greigg

[57] ABSTRACT

A fuel injection system for internal combustion engines having a fuel injection pump and a relief conduit in which a control throttle is disposed for measuring the quantity of fuel flowing out, and wherein the differential pressure effected by the throttle is measured by a differential pressure measuring unit and converted into an electrical variable, in order then to be fed to an electronic control unit by which the fuel injection system is regulated.

17 Claims, 1 Drawing Sheet

FUEL INJECTION SYSTEM FOR INTERNAL COMBUSTION ENGINES

BACKGROUND OF THE INVENTION

The invention is directed to improvements in fuel injection systems for internal combustion engines.

In a known fuel injection system of this type (German Offenlegungsschrift 29 42 010), the relief conduit includes a control throttle the cross section of which is variable via a control motor and which in combination with a magnetic valve disposed in a parallel relief conduit and by triggering with the electronic control unit determines the injection principle. While the onset and end of fuel supply are determinable by the magnetic valve, a prolongation of the injection duration and hence quiet operation of the engine ar attainable by means of the control throttle, which can throttle down to a zero fuel quantity. By allowing part of the fuel to drain away during the injection event, this fuel quantity is compensated for by a corresponding prolongation of the injection duration.

For the rpm regulation, the engine rpm serves as a control variable, here, because an actual fuel injection quantity metering does not take place. Regulation of this kind has the disadvantage, however, that it is relatively sluggish, since the injection quantity cannot be varied except via a comparison of the actual and setpoint values of the rpm inside the electronic control unit and naturally other engine parameters such as load, temperature and so forth must be processed in the electronic control unit as well. An indirect measurement of this kind is particularly disadvantageous whenever the control throttle has only a specialized task such a prolonging the injection duration and hence complicates the overall regulation considerably.

In this known injection system, the fuel return quantity can also be derived from the respective control variable of the control motor that actuates the variable throttle. However, such a compensation calculation performed in the electronic control unit on the basis of control motor feedback variables involves complex mathematical functions, since the control path of the control motor has a correspondingly complicated relationship with the relief quantity flowing through the throttle. These are higher order functions, since the change in throttle cross section and the pumping course of the injection pump cause changes in the fuel pressure in the relief conduit.

OBJECT AND SUMMARY OF THE INVENTION

It is a principal object of the fuel injection system according to the invention to provide the advantage over the prior art that a direct measurement of the relief quantity flowing through the relief conduit is made, which then, fed to the electronic control unit, can bring about fast, purposeful control of the injection quantity.

It is another object of the invention to provide that, because of the predetermined cross section of the control throttle a linearization of the control functions can also be effected, or the control variables can be made comparable, so that by simple means, precise injection quantity determination or rpm regulation is attainable.

Although it is known from British patent application Ser. No. 2,141,787 to control the onset and end of fuel supply by a fuel injection pump via a magnetic valve, where the fuel return quantity is detected by a deflecting member actuated by the pump and the actuation of this measuring member measure the return flow onset and return flow end and hence the supply onset and end nevertheless, because of the lack of a predetermined throttle and of a measuring member detecting the differential pressure at this throttle, this device only serves as a flow meter—not as a quantity meter.

It is yet another object and a very advantageous feature of the invention that the quantity measuring device has a control member that yields counter to a restoring force, is acted upon by relief fuel, and is controlled by the pressure drop the control travel of this control member can be fed to the electronic control unit via a travel transducer. Advantageously, the control throttle thus acts as a differential pressure transducer for the quantity meter; various embodiments are possible.

In a preferred embodiment, the restoring force varies over the control travel distance in accordance with a quadratic function; a spring having a suitable characteristic curve serves for example as the restoring force. Since the throttle equation, that is, the function between a quantity of fluid flowing through a throttle and the resultant pressure difference at this throttle, is quadratic, a control member actuated by the variation in the pressure difference and likewise having a quadratic function effects a linearization of the functions. Because of the predetermined throttle cross section and because of a control member loaded with a force varying quadratically over the travel distance, eliminating the quadratic degrees of functions connecting the pressure, quantity and travel thus produces a measurement value which is linearly proportional to the relief quantity and so can be fed to the electronic control unit as a value proportional to the relief quantity. Either a piston or a diaphragm can be used as the control member.

It is still another object of the invention and a further advantageous feature thereof that the control throttle be variable, although the particular throttle cross section set at a given time serves as one of the control variables of the electronic control unit, so that especially in a linearization of the functions, the control plane is merely shifted.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
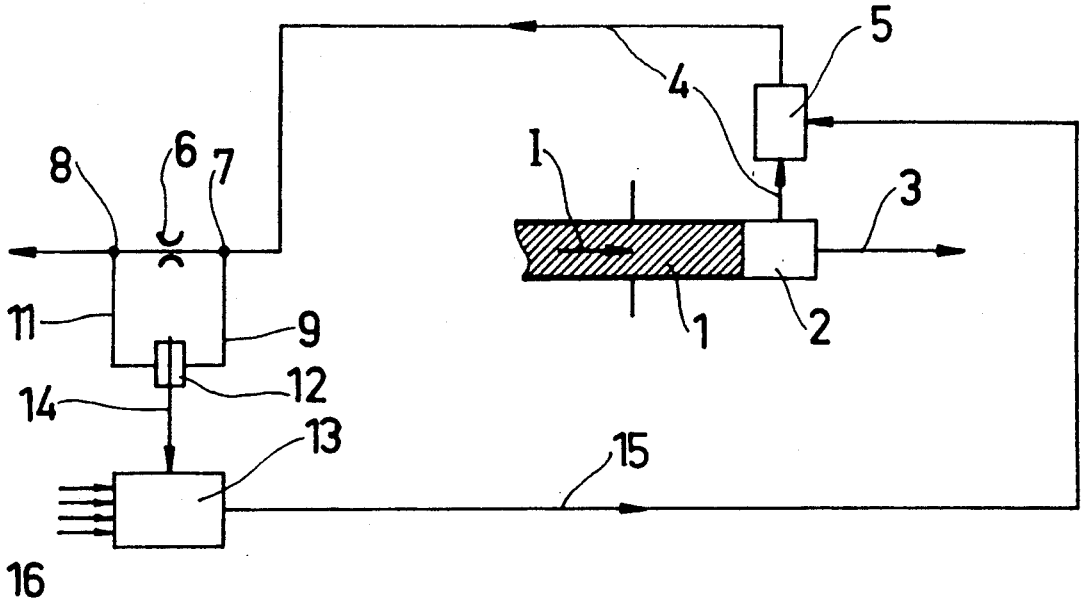
FIG. 1 is a circuit diagram for the injection system according to the invention.

In the circuit diagram shown in FIG. 1, a fuel injection pump is shown in very simplified fashion, having a pump piston 1 and a pump work chamber 2; fuel lines 3, only one of which is shown, lead from the work chamber to the internal combustion engine, not shown, and a relief conduit 4, which leads to a chamber of lower pressure, also branches off from the work chamber.

A magnetic valve 5 and a control throttle 6 of predetermined cross section ar disposed in the relief conduit 4. For the sake of transmitting the pressure prevailing in each location, the location 7 upstream of the control throttle 6 and the location 8 downstream of the control throttle 6 are connected via lines 9 and 11 to a differential pressure measuring unit 12.

An electronic control unit 13 is connected to the differential pressure measuring unit 12 via an electric line 14 and to the magnetic valve 5 via an electric line 15. Via electric lines 16, engine parameters such as rpm, load, temperature and the like are fed to the electronic control unit 13 where they are processed for controlling the rpm, or for controlling the injection in general.

This fuel injection system operates a follows: In its compression stroke represented by the arrow I, the pump piston 1 pumps fuel from the pump work chamber 2 via the pressure line 3 to the engine. Fuel can also drain away without pressure via the relief conduit 4. Thus the onset and end of supply to the engine are controlled by the magnetic valve 5 in the relief conduit 4. This valve opens prior to the onset of supply, so that fuel can drain away unused via the relief conduit 4, and the valve then closes for the supply onset, so that the fuel now positively displaced by the pump piston 1 is pumped via the pressure line 3. As soon as the desired fuel quantity has been injected into the engine, the electronic control unit 13 then, via the electric line 15, effects an opening of the magnetic valve 5, so that because of the opening of the relief conduit 4 the fuel continuing to be positively displaced by the pump piston 1 can drain away without pressure.

By additional control devices, for example inflow and outflow openings controlled directly by the pump piston 1, the relief conduit can also be used for allowing only some of the pumped fuel quantity to drain out, so that the rest attains injection through the pressure line 3. In such a case, the magnetic valve 5 can be used for prolonging the injection duration in order to abate combustion noise during idling and at relatively low rpm.

Because of the control throttle 6, through which the relieved fuel quantity must flow, there is a pressure drop between the locations 7 and 8 which is converted via the lines 9 and 11 in the pressure measuring unit 12 into an electrical variable that is then fed via the electric line 14 to the electronic control unit 13. In each case, the differential pressure represents a value for the fuel quantity flowing through the control throttle 6 so that the electrical output variable of the differential pressure measuring unit also corresponds to the quantity of fuel flowing through the throttle 6. This electrical variable corresponding to the relief quantity is processed in the electronic control unit 13 in such a way that the desired injection principle is obtained. Naturally the circuit can also have a different appearance; the definitive factor is that a fuel quantity that must be taken into account as a characteristic variable in regulating the fuel injection is measured via a predetermined control throttle cross section.

Figure 2:
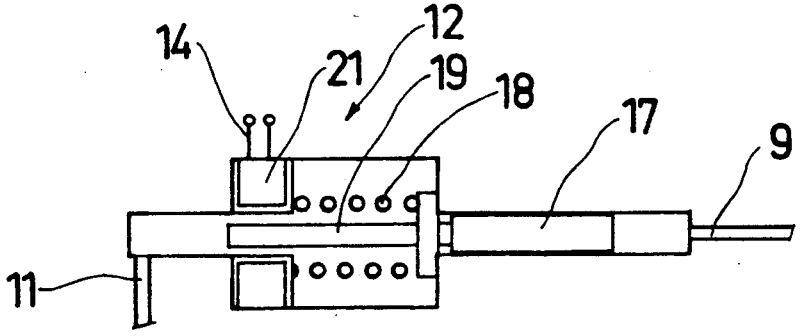
FIGS. 2 and 3 show two different variants of the quantity meter used in FIG. 1.

In FIG. 2, the differential pressure measuring unit 12 is shown, highly simplified, in section. Via the lines 9 and 11, the differential pressure prevailing at the control throttle 6 is fed to this unit. This differential pressure acts upon a measuring piston 17, which is urged by a measuring spring 18 in the direction of line 9 and is displaceable counter to this measuring spring 18 only when the differential pressure is high enough. An armature 19 disposed on the measuring piston 17 protrudes into a measuring coil 21, which is connected via the electric line 14 to the electronic control unit 13. Depending on how far the armature 19 protrudes into the coil 21, the electrical flux of the coil varies, so that for each armature position, a predetermined electrical value is sent to the electronic control unit 13. The cross sectional area of the measuring piston 17 and the force or characteristic curve of the measuring spring 18 are definitive for the differential pressure-dependent adjustment of the armature 19. Since the law of flow quantity at a throttle of predetermined cross section obeys a quadratic function, as explained above, it is thus possible, with a correspondingly quadratic function of the characteristic curve of the measuring spring 18 to provide that the relief quantity flowing through the control throttle 6 will correspond linearly to a corresponding travel distance of the armature 19, so that the electrical value of the coil 21 is directly equivalent to the relief quantity.

Figure 3:
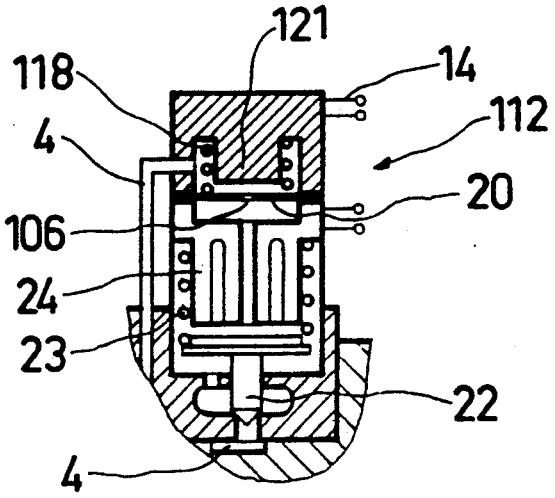

The differential pressure measuring unit 112 shown in FIG. 3 is combined with the magnetic valve 5, so that the relieved fuel must first flow past the movable valve element 22 in order to reach the control throttle 106, which is disposed in a diaphragm 20. The movable valve element 22 is loaded by a closing spring 23 and cooperates with a magnet 24. The diaphragm 20 is loaded by a measuring spring 18, which has a predetermined characteristic curve. The diaphragm 20 also cooperates with an indicator 121 made of suitable iron, so that a particular electrical value is established for the particular distance, resulting from the pressure difference at the control throttle 106, between the diaphragm 20 and the indicator 121; this value is fed via the electric line 14 to the electronic control unit.

All the characteristics described above, shown in the drawing and recited in the following claims may be essential to the invention either singly or in any arbitrary combination with one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for an internal combustion engine comprising a fuel injection pump having a pump work chamber provided with pressure lines leading to the engine, at least one pressure relief conduit leading to a chamber of lower pressure branching off from the pump work chamber, a control throttle being disposed in the relief conduit, a magnetic valve (5) in said pressure relief conduit upstream of said control throttle that controls fuel flow from said pump work chamber via said pressure relief conduit to said control throttle, an electronic control unit (13) for processing engine parameters and characteristics of the injection system for determining injection operation, the control throttle being provided with a predetermined cross section, a differential pressure measuring means (12) being provided for measuring a pressure drop at the control throttle effected by a relief fuel quantity flowing through said control throttle, said pressure drop measurement serving as an electrical control variable signal fed to said electronic control unit (13), whereby said electrical control variable signal corresponds to the quantity of fuel flowing through said throttle.

2. A fuel injection system as defined by claim 1, further wherein the fuel differential pressure measuring means has a control member operative counter to a restoring force applied thereto, said control member being acted upon by the relief fuel quantity and controlled by the pressure drop, and a control travel distance travelled by the control member is communicated via a travel transducer to the electronic control unit.

3. A fuel injection system as defined by claim 2 further wherein the restoring force varies over the control travel distance in accordance with a quadratic function.

4. A fuel injection system as defined by claim 2, further wherein a helical measuring spring serves a the restoring force.

5. A fuel injection system as defined by claim 3, further wherein a helical measuring spring serves as the restoring force.

6. A fuel injection system as defined by claim 1, further wherein said differential pressure measuring means comprises a measuring piston.

7. A fuel injection system as defined by claim 2, further wherein the control member comprises a measuring piston.

8. A fuel injection system as defined by claim 3, further wherein the control member comprises a measuring piston.

9. A fuel injection system as defined by claim 4, further wherein the control member comprises a measuring piston.

10. A fuel injection system as defined by claim 5, further wherein the control member comprises a measuring piston.

11. A fuel injection system as defined by claim 1, further wherein said differential pressure measuring means comprises a diaphragm in which the control throttle is disposed.

12. A fuel injection system as defined by claim 2, further wherein the control member comprises a diaphragm in which the control throttle is disposed.

13. A fuel injection system as defined by claim 3, further wherein the control member comprises a diaphragm in which the control throttle is disposed.

14. A fuel injection system as defined by claim 4, further wherein the control member comprises a diaphragm in which the control throttle is disposed.

15. A fuel injection system as defined by claim 5, further wherein the control member comprises diaphragm in which the control throttle is disposed.

16. A fuel injection system as defined by claim 1, further wherein the control throttle is variable in cross section.

17. A fuel injection system as defined by claim 11, further wherein the control throttle is variable in cross section.

* * * * *